US005983854A

United States Patent [19]

Machida et al.

[11] Patent Number: 5,983,854

[45] Date of Patent: Nov. 16, 1999

[54] CONTROL APPARATUS OF DIRECT INJECTION SPARK IGNITION TYPE INTERNAL COMBUSTION ENGINE

[75] Inventors: Kenichi Machida; Satoru Watanabe, both of Atsugi; Kenichi Goto, Zama; Hideyuki Tamura, Yokohama, all of Japan

[73] Assignees: Unisia Jecs Corporation; Nissan Motor Co., Ltd., both of Kanagawa-ken, Japan

[21] Appl. No.: 09/106,761

[22] Filed: Jun. 30, 1998

[30] Foreign Application Priority Data

Jun. 30, 1997 [JP] Japan ..... 9-173943

[51] Int. Cl.[6] ..... F02B 17/00; F02B 41/22

[52] U.S. Cl. ..... 123/295; 701/107

[58] Field of Search ..... 123/295, 305, 123/298, 480, 479; 701/107

[56] References Cited

U.S. PATENT DOCUMENTS 5,896,839 4/1999 Togai ..... 123/295

FOREIGN PATENT DOCUMENTS 59-37236 2/1984 Japan .

*Primary Examiner*—Tony M. Argenbright
*Assistant Examiner*—Arnold Castro
*Attorney, Agent, or Firm*—McDermott, Will & Emery

[57] ABSTRACT

The present invention securely prevents the erroneous switching of the combustion mode to the stratified charge combustion, and avoids deterioration of the driving performance. In order to do so, apart from a software determination device inside a main CPU for performing the permission determination on the switching to the stratified charge combustion based on an input signal related to the engine drive condition, a hardware detection circuit (gate array) is equipped for performing the permission determination on the switching to the stratified charge combustion mode based on the input signal related to the engine drive condition. The main CPU is equipped with a combustion mode order device for finally ordering the stratified charge combustion by permitting the switching to the stratified charge combustion only when the two permission determinations both permit the switching to the stratified charge combustion. Further, a sub CPU is mounted which is equipped with a fail-safe device for based on the final permission determination from the main CPU and the permission determination from the hardware determination device, performing a fail-safe process when the two determinations are inconsistent.

6 Claims, 5 Drawing Sheets

CONTROL APPARATUS OF DIRECT INJECTION SPARK IGNITION TYPE INTERNAL COMBUSTION ENGINE

BACKGROUND OF THE INVENTION (1). Field of the Invention

The present invention relates to a control apparatus of a direct injection spark ignition type internal combustion engine, and more specifically, to a technique for controlling the switching of the combustion mode between a uniform charge combustion mode and a stratified charge combustion mode in response to the engine driving condition.

(2). Related Art of the Invention

Conventionally, a direct injection spark ignition type internal combustion engine is attracting attention, which, corresponding to the engine driving condition, is generally controlled to switch the combustion mode between a uniform charge combustion where fuel is injected during an intake stroke, thereby diffusing fuel into the combustion chamber and forming a uniform air-fuel mixture, and a stratified charge combustion where fuel is injected during a compression stroke, thereby forming a stratified air-fuel mixture concentrated around an ignition plug (refer to Japanese Unexamined Patent Publication No.59-37236).

However, in the prior art, the determination to permit the switching to the stratified charge combustion mode is performed only by a software, which leaves a possibility that erroneous determination may be performed. Especially when switching to the stratified charge combustion is performed erroneously under the condition where the uniform charge combustion should be performed, there is a fear that deterioration of the driving performance may happen.

The present invention aims at solving the conventional problems, by preventing without fail the erroneous switching to the stratified charge combustion, and avoiding the deterioration of the driving performance.

SUMMARY OF THE INVENTION

In order to achieve the above mentioned object, the present invention relates to a control apparatus of a direct injection spark ignition type internal combustion engine comprising a fuel injection valve for directly injecting fuel into a combustion chamber of the engine, and, according to the engine driving condition, controlling the switch between a uniform charge combustion performed by injecting fuel during an intake stroke and a stratified charge combustion performed by injecting fuel during a compression stroke, wherein apart from a software determination device mounted inside a main CPU for performing a permission determination on the switching to the stratified charge combustion based on an input signal related to the engine driving condition, a hardware determination circuit is further equipped for performing a permission determination on the switching to the stratified charge combustion based on the input signal related to the engine driving condition, and one part of the determination on the permission to switch to the stratified charge combustion mode is allotted to the hardware.

Then, the main CPU is equipped with a combustion mode order device for, based on the determination on permission by the software determination device and the determination on permission by the hardware determination circuit, finally ordering the switching to the stratified charge combustion by performing the permission determination on the switching to the stratified charge combustion only when both determinations permit the switching to the stratified charge combustion, and for ordering the uniform charge combustion in conditions other than the above, thereby, erroneous switching to the stratified charge combustion can be prevented, and the deterioration of the driving performance can be avoided.

In the present invention, apart from the main CPU, a sub CPU is further equipped. In the sub CPU, a fail-safe determination device is equipped for performing, based on the final determination on permission from the combustion mode order device inside the main CPU and the determination on permission from the hardware determination circuit, a fail-safe process when the determinations are inconsistent, thereby dealing with the disorder of the main CPU itself.

As the fail-safe process, the fail-safe determination device either controls the throttle valve to shut forcibly, or switches the combustion mode from the stratified charge combustion to the uniform charge combustion forcibly.

Further, when the stratified charge combustion is performed during the idle driving condition of the engine, the hardware determination circuit may simply be constructed to permit the switching to the stratified charge combustion during the idling condition of the engine according to a signal from an idle switch.

Moreover, the hardware determination circuit may simply be formed by a gate array.

The characteristic structure and the effects based on the present invention are made clear from the following description of the preferred embodiments.

DETAILED DESCRIPTION OF THE PREFERRED EMBODIMENT

Figure 1:
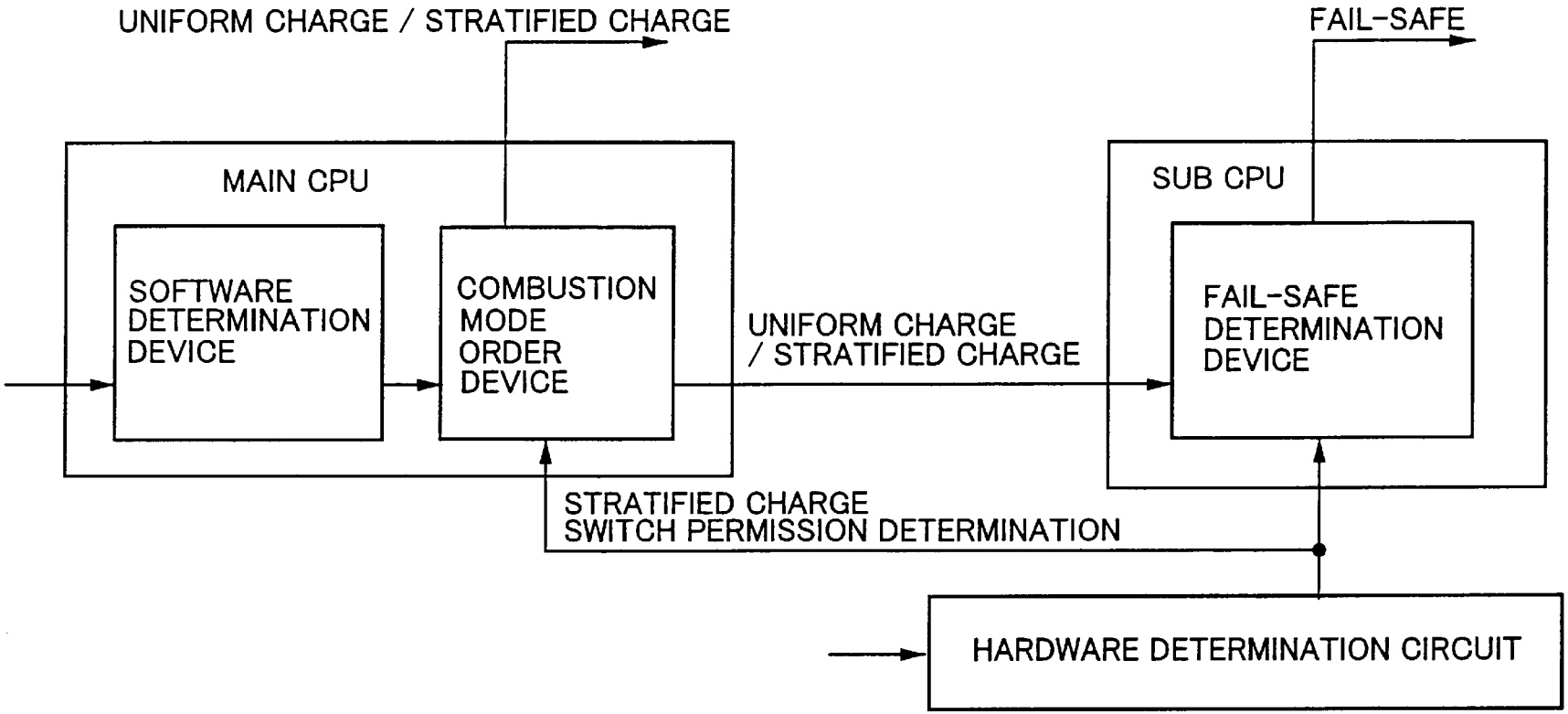
FIG. 1 is a function block diagram showing the basic structure according to the present invention.

The basic structure of the control apparatus of the direct injection spark ignition type internal combustion engine according to the present invention is as shown in FIG. 1, and the embodiment thereof is explained with reference to FIGS. 2 to 6.

Figure 2:
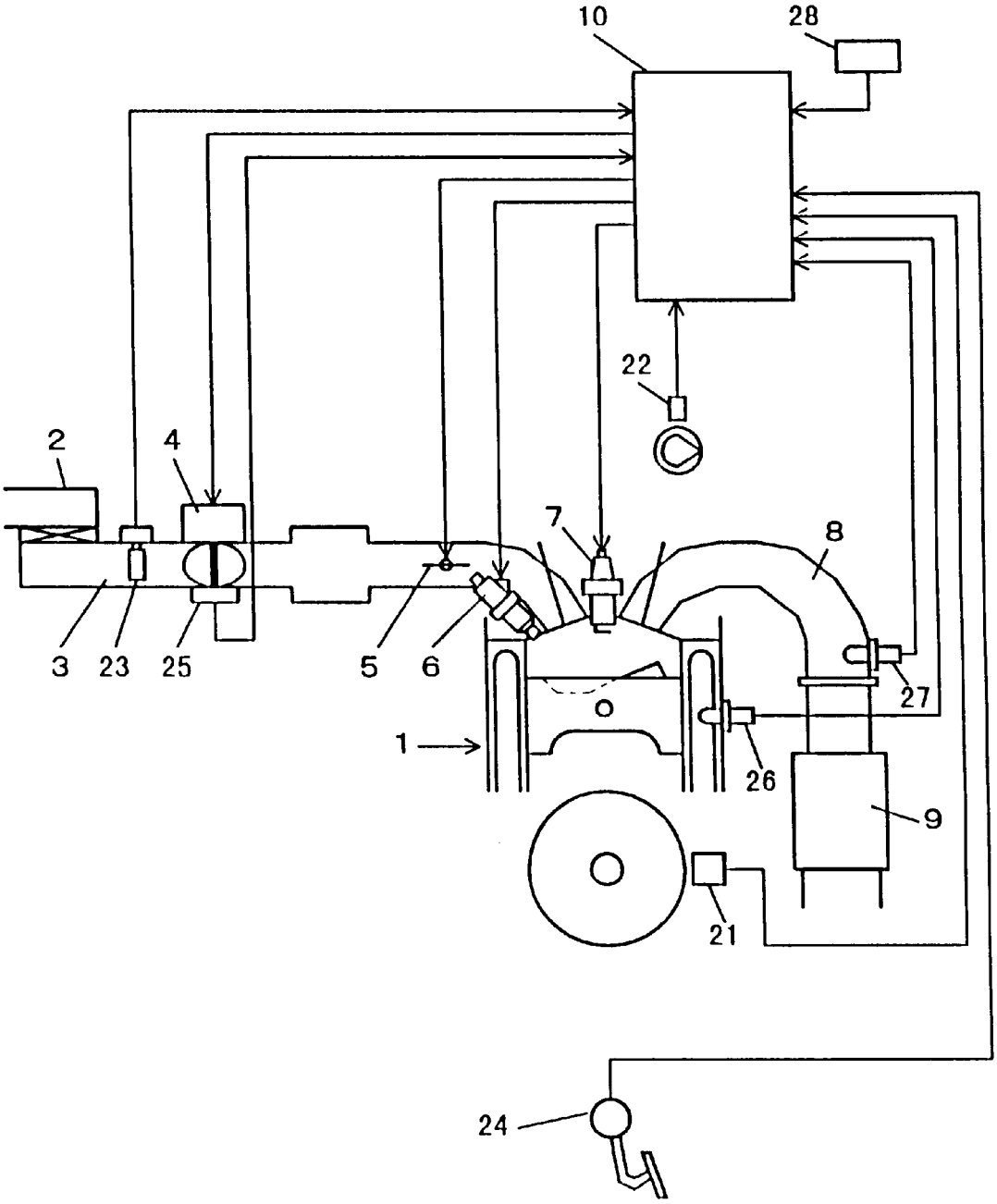
FIG. 2 is a system diagram of the internal combustion engine showing one embodiment according to the present invention.

FIG. 2 is a system diagram of the internal combustion engine showing one embodiment. The details thereof will now be explained.

In a combustion chamber of each cylinder in an internal combustion engine 1 mounted in a vehicle, air is sucked in from an air cleaner 2 through an intake passage 3 with control of an electronic controlled throttle valve 4. A swirl control valve 5 is further equipped, which controls the port cross-sectional area, and enables to control the flow of air sucked into the combustion chamber.

Further, an electromagnetic type fuel injection valve (injector) 6 is mounted on the combustion chamber for directly injecting fuel (gasoline) thereto.

The fuel injection valve 6 is driven to open by power being provided to a solenoid according to an injection pulse signal being outputted during either an intake stroke or a compression stroke from a control unit 10 described in detail below in synchronization to the engine rotation, and injects fuel being adjusted to a predetermined pressure. Then, in case of an intake stroke injection, the injected fuel forms a uniform air-fuel mixture by being diffused inside the combustion chamber, and in the case of a compression stroke injection, it forms a stratified air-fuel mixture concentrated around an ignition plug 7. Then, based on an ignition signal from the control unit 10 described in detail below, the fuel is ignited by the ignition plug 7, and combusted (either by uniform charge combustion or by stratified charge combustion).

The exhaust from the engine 1 is discharged from an exhaust passage 8, and a catalytic converter 9 for purifying exhaust is equipped to the passage 8.

The control unit 10 is equipped with a main CPU, a sub CPU and the like, which receives input signals from various sensors, carries out calculation based on the signals, and controls the action of the electronic controlled throttle valve 4, the fuel injection valve 6, and the ignition plug 7.

Included in the various sensors are crank angle sensors 21, 22 for detecting the crank axis or the cam axis rotation of the engine 1. When the number of cylinders are set as number n, these crank angle sensors 21 and 22 output a reference pulse signal REF in a previously set crank angle position (for example, 110° before compression top dead center) for every crank angle 720°/n, and at the same time, output a unit pulse signal POS every 1 to 2 degree, and it is capable of calculating the engine rotation speed Ne from the cycle of the reference pulse signal REF and the like. Especially, the cam axis sensor 22 outputs a cylinder discrimination signal PHASE corresponding to a specific cylinder in a previously set crank angle position for every crank angle 720°, which enables to discriminate the cylinder.

Other than the above, there are provided an airflow meter 23 for detecting an intake air flow quantity Qa at the upstream side of the throttle valve 4 on the intake passage, an accelerator sensor 24 for detecting the accelerator pedal step-in quantity (accelerator opening) APS, a throttle sensor 25 for detecting the throttle valve 4 opening TVO (including an idle switch being turned on when the throttle valve 4 is fully closed), a water temperature sensor 26 for detecting the cooling water temperature Tw of the engine 1, an oxygen sensor 27 positioned in the exhaust passage 8 for outputting a signal in correspondence to the rich/lean of the exhaust air-fuel ratio, a vehicle speed sensor 28 for detecting the vehicle speed VSP, and so on.

Next is an explanation of the switching control of the combustion mode performed by the control unit 10. In the example, the stratified charge combustion is performed under the idling condition of the engine.

Figure 3:
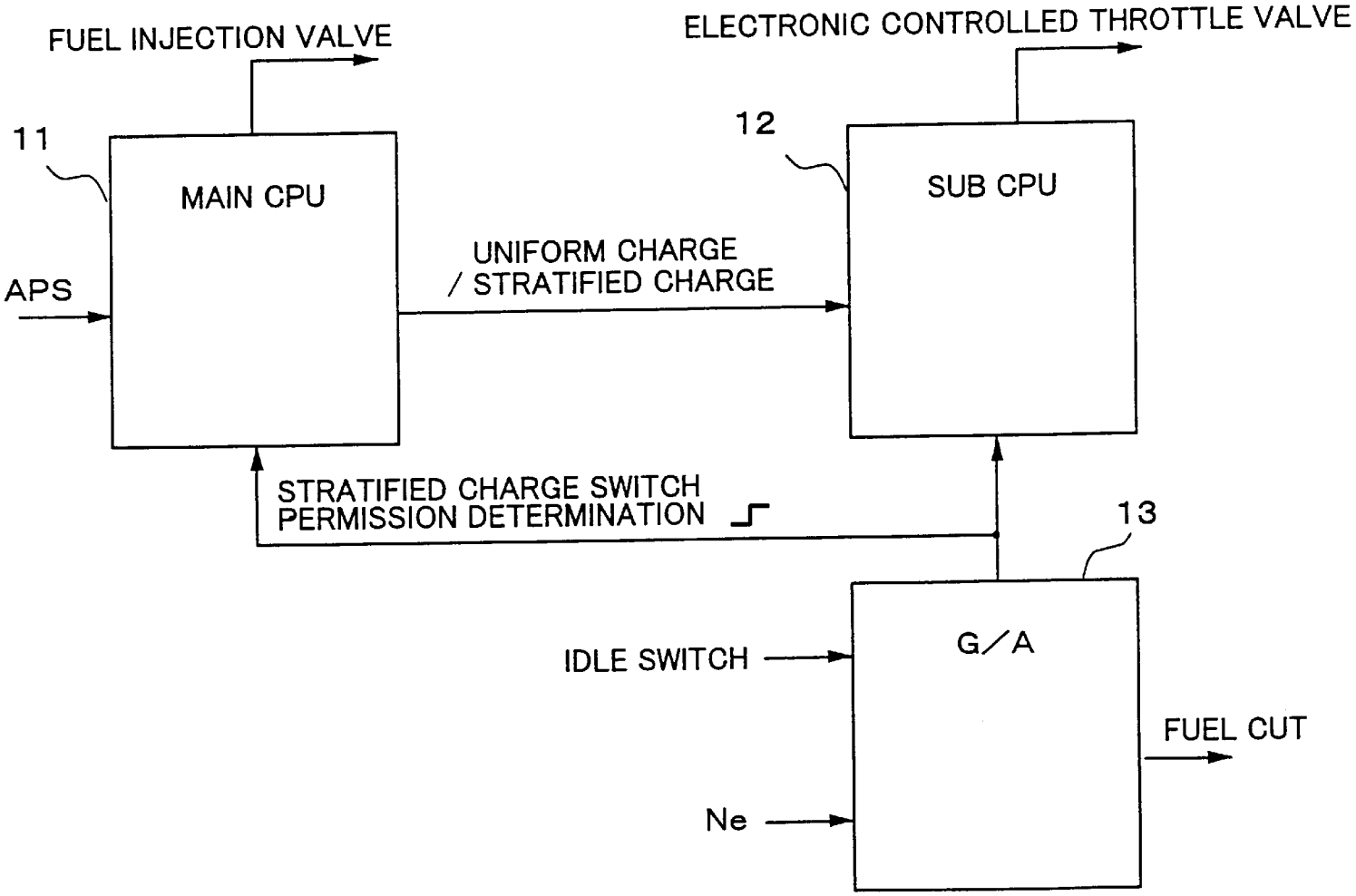
FIG. 3 is a block diagram showing the hardware composition inside the control unit.

FIG. 3 shows the hardware composition inside the control unit 10, comprising a main CPU 11, a sub CPU 12, and a gate array 13.

The main CPU 11 has a program as a software determination device for performing the permission determination of the switching to the stratified charge combustion based on the input signal related to the engine driving condition.

Figure 4:
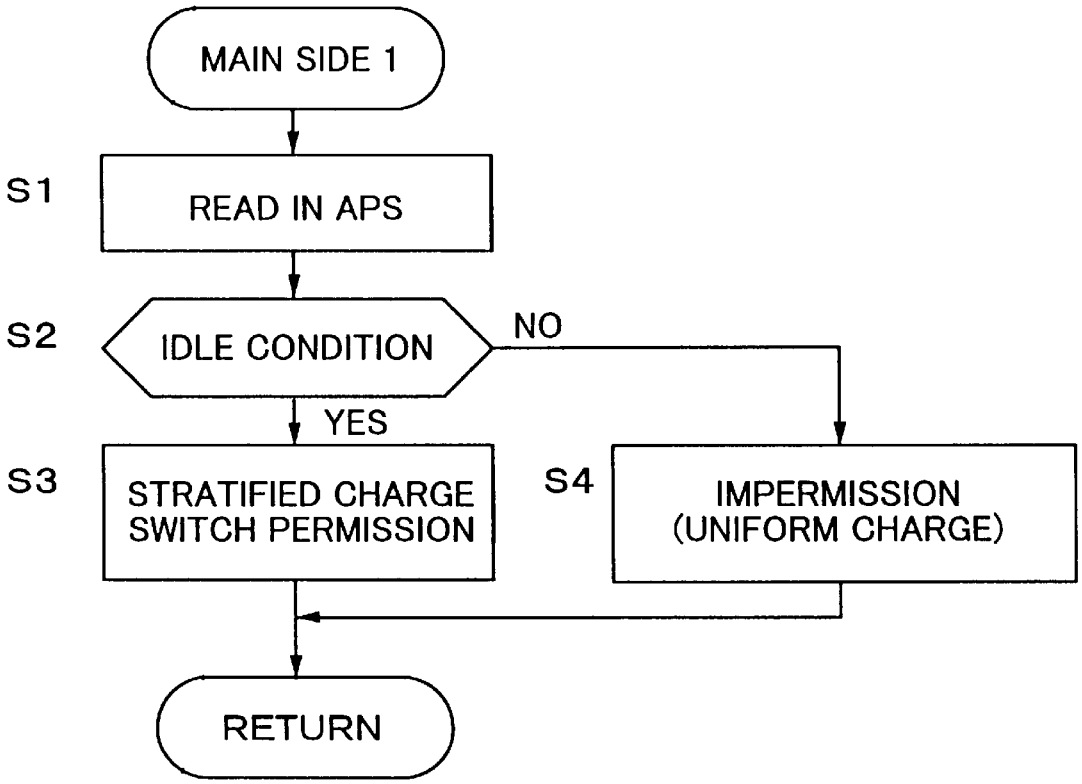
FIG. 4 is a flowchart of the first routine by the main CPU.

Actually, when at least an accelerator opening APS signal is input from the accelerator sensor 24, and as shown in the flowchart of FIG. 4, the accelerator opening APS is read in (S1), determination is performed on whether or not an idling condition is fulfilled (S2), and if it is determined that the idle drive condition is fulfilled, then the switching to the stratified charge combustion is permitted (S3). When it is determined that the idle drive condition is not fulfilled, then the uniform charge combustion should be carried out, and the switching to the stratified charge combustion is not permitted (S4).

Separately from the software determination device inside the main CPU 11, a gate array 13 is mounted thereto as a hardware circuit for performing the permission determination of the switching to the stratified charge combustion based on the input signal related to the engine drive condition.

At least a signal from an idle switch 25 and the engine rotation speed Ne signal are input to this gate array 13. In the condition where the idle switch is on and Ne>1800 rpm, the gate array outputs a fuel cut signal as a safety measure, and by utilizing this function, in the condition where the idle switch is on (or when the idle switch is on and Ne≦1800 rpm), the gate array outputs a signal permitting the switching to the stratified charge combustion, and sends it out to the main CPU 11 and the sub CPU 12.

On the other hand, the main CPU 11 is equipped with a program as a combustion mode order device, wherein based on the permission determination by the software determination device (the flowchart of FIG. 4) and the permission determination from the gate array 13 working as the hardware determination circuit, the switching to the stratified charge combustion is finally permitted and the stratified charge combustion is ordered only when both determinations permit the switching to the stratified charge combustion mode, and in other cases, the uniform charge combustion is ordered.

Figure 5:
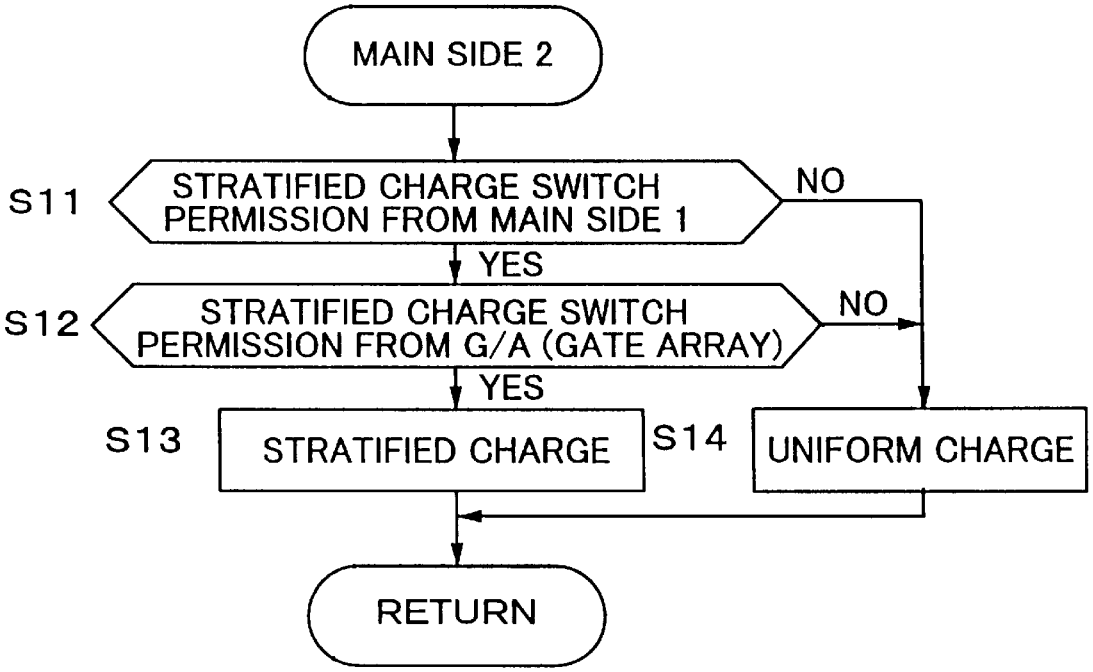
FIG. 5 is a flowchart of the second routine by the main CPU.

Actually, when the signal from the gate array 13 is input, as shown in the flowchart of FIG. 5, determination is made on whether the switching to the stratified charge combustion is permitted by the software determination device (flowchart of FIG. 4) inside the main CPU 11 (S11), and determination is also made on whether the switching to the stratified charge combustion is permitted by the gate array 13 (S12). Then, if both determinations permit to the switching to the stratified charge combustion, the switching to the stratified charge combustion is finally permitted and the stratified charge combustion is ordered (S13), but if not, the uniform charge combustion is ordered (S14).

Thereby, the erroneous switching to the stratified charge combustion caused by the software determination device can be prevented, and the driving performance can be secured.

Further, in the case of the uniform charge combustion, the fuel injection quantity is set to either a value equivalent to a stoichiometric air-fuel ratio (14.6) or to a lean air-fuel ratio where the air-fuel ratio is 20 to 30. On the other hand, the injection timing is set to the intake stroke, and the action of the fuel injection valve 6 is controlled. In the case of the stratified charge combustion, the fuel injection quantity is set to a value equivalent to a lean air-fuel ratio where the air-fuel ratio is approximately 40, and on the other hand, the injection timing is set to the compression stroke, and the action of the fuel injection valve 6 is controlled.

The sub CPU 12 is equipped with a program as a fail-safe determination device performing a fail-safe performance when the determinations of the final permission determination from the combustion mode order device (flowchart of FIG. 5) inside the main CPU 11 and the permission determination from the gate array 13 working as the hardware determination circuit are inconsistent.

Figure 6:
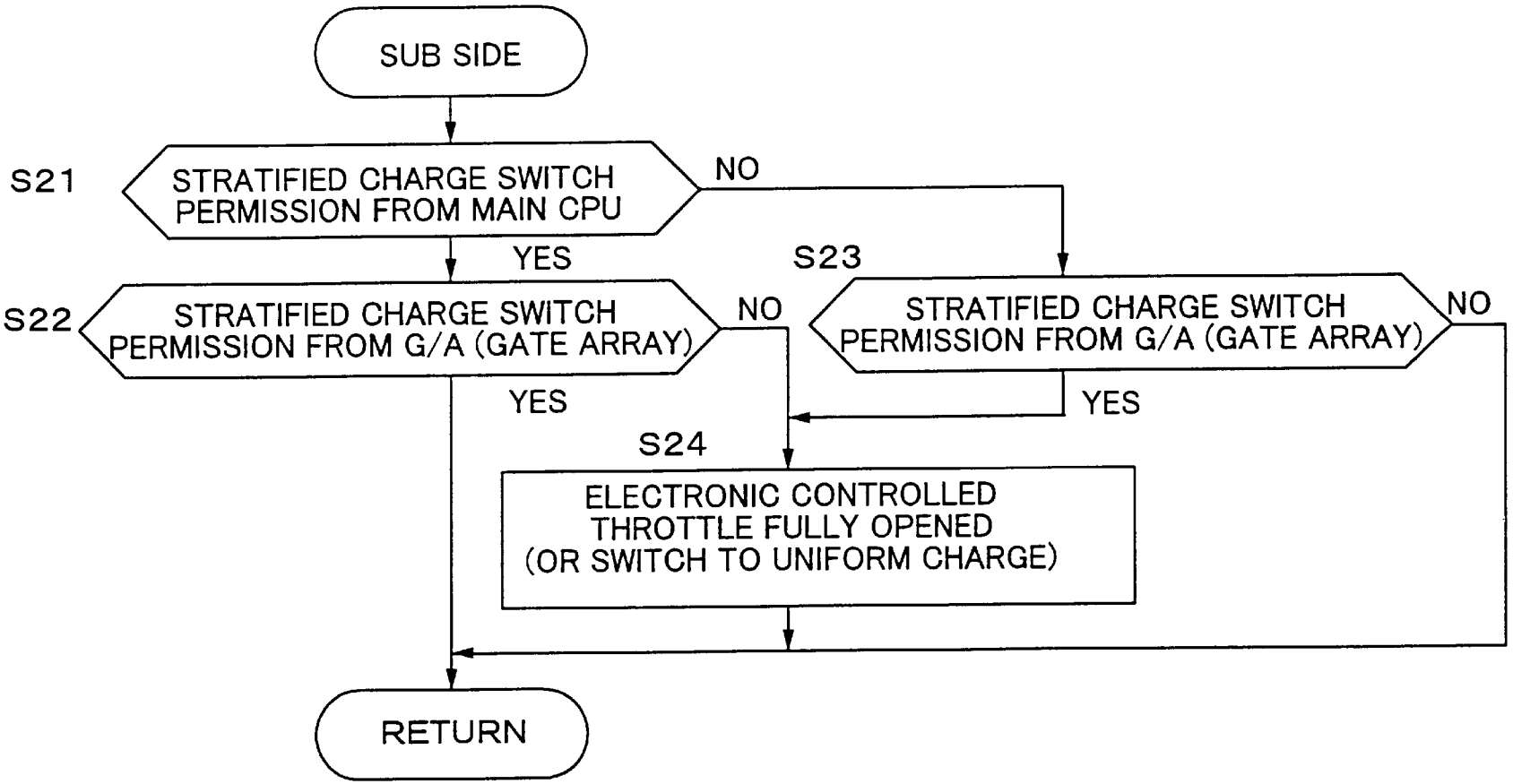
FIG. 6 is a flowchart of the fail-safe process routine by the sub CPU.

Actually, when a signal from the main CPU 11 and the signal from the gate array 13 are input, as shown in the flowchart of FIG. 6, determination is made on whether the switching to the stratified charge combustion is permitted by the main CPU 11 (S21), and determination is further made on whether the switching to the stratified charge combustion is permitted by the gate array 13 (S22, S23).

As a result, in the case where, although the switching to the stratified charge combustion is permitted by the main CPU 11, the switching to the stratified charge combustion is not permitted by the gate array 13, or in the case where, although the switching to the stratified charge combustion is not permitted by the main CPU 11, the switching to the stratified charge combustion is permitted by the gate array 13, as the fail-safe process, either the electronic controlled throttle valve 4 is forcibly controlled to a fully closed position, or the combustion mode is switched forcibly from the stratified charge combustion to the uniform charge combustion (S24). In such case, the full close control of the throttle valve 4 and the forcible switching to the uniform charge combustion can be performed simultaneously.

Such fail-safe process can deal with disorder of the main CPU 11 itself.

As was explained above, according to the present invention, a hardware determination circuit is equipped, apart from a software determination device inside the main CPU for performing the permission determination of the switching to the stratified charge combustion based on the input signal related to the engine driving condition, wherein one part of the permission determination of the switching to the stratified charge combustion is allotted to the hardware. The permission determination by the software determination device and that by the hardware determination circuit are compared with each other, and the switching to the stratified charge combustion is ordered by finally permitting the switching to the stratified charge combustion only when both determinations permit to the switching of the combustion mode to the stratified charge combustion. Therefore, the present invention is effective in that the erroneous switching to the stratified charge combustion can be prevented, and that the deterioration of the driving performance can be avoided, thereby having large advantages in productivity.

What we claimed are:

1. A control apparatus of a direct injection spark ignition internal combustion engine comprising a fuel injection valve for directly injecting fuel into a combustion chamber of the engine, according to the engine driving condition, controlling the switching between a uniform charge combustion which is performed by injecting fuel during an intake stroke and a stratified charge combustion which is performed by injecting fuel during a combustion stroke: wherein apart from a software determination means inside a main CPU for performing a permission determination on the switching to the stratified charge combustion based on an input signal related to the engine driving condition, a hardware determination circuit is equipped for performing the permission determination on the switching to the stratified charge combustion based on the input signal related to the engine driving condition; and a combustion mode order means is equipped to said main CPU for, based on the permission determination by said software determination means and the permission determination by said hardware determination circuit, said means, ordering the stratified charge combustion by finally permitting the switching to the stratified charge combustion only when said two determinations both permit to the switching to the stratified charge combustion, and ordering the uniform charge combustion in other conditions.

2. A control apparatus of a direct injection spark ignition internal combustion engine according to claim 1, wherein a sub CPU is mounted apart from said main CPU, and said sub CPU is equipped with a fail-safe determination means for, based on the final permission determination from said combustion mode order mean s inside said main CPU and the per mission determination from said hardware determination circuit, performing a fail-safe process when said two determinations are inconsistent.

3. A control apparatus of a direct injection spark ignition internal combustion engine according to claim 2, wherein said fail-safe determination means forcibly controls a throttle valve to close as said fail-safe process.

4. A control apparatus of a direct injection spark ignition internal combustion engine according to claim 2, wherein said fail-safe determination means forcibly switches the combustion mode from said stratified charge combustion to said uniform charge combustion as said fail-safe process.

5. A control apparatus of a direct injection spark ignition internal combustion engine according to claim 1, wherein on condition that said stratified charge combustion is performed under an idle drive condition of the engine, said hardware determination circuit is set to output a signal permitting the switching to the stratified charge combustion under said idling condition of the engine based at least on a signal from an idle switch.

6. A control apparatus of a direct injection spark ignition internal combustion engine according to claim 1, wherein said hardware determination circuit comprises a gate array.

* * * * *